United States Patent [19]

Davis

[11] Patent Number: 4,477,049

[45] Date of Patent: Oct. 16, 1984

[54] CHRISTMAS TREE STAND

[76] Inventor: John H. Davis, 3796 Stewart Rd., Eugene, Oreg. 97402

[21] Appl. No.: 402,128

[22] Filed: Jul. 26, 1982

[51] Int. Cl.[3] ..... A47B 33/12

[52] U.S. Cl. ..... 248/524; 47/40.5

[58] Field of Search ..... 248/524, 523, 525, 526, 248/527; 47/40.5

[56] References Cited

U.S. PATENT DOCUMENTS

| | | | |
|---|---|---|---|
| 1,151,745 | 8/1915 | Wagner | 248/524 |
| 1,481,015 | 1/1924 | Klein | 248/524 |
| 2,500,215 | 3/1950 | Swearingen | 248/524 |
| 3,562,951 | 2/1971 | Schwaderlapp | 248/524 |
| 3,697,026 | 10/1972 | Hambrick | 248/524 |
| 4,254,578 | 3/1981 | Hanfeld | 248/524 |

FOREIGN PATENT DOCUMENTS

| | | | |
|---|---|---|---|
| 658283 | 2/1963 | Canada | 47/40.5 |
| 1484784 | 9/1977 | United Kingdom | 248/523 |

*Primary Examiner*—Reinaldo P. Machado
*Assistant Examiner*—Alvin Chin-Shue
*Attorney, Agent, or Firm*—Lee R. Schermerhorn

[57] ABSTRACT

A tree holder bar and an inverted U-shaped support bar are welded at their lower ends to a circular base ring, leaving an open space to receive a water container. Upper portions of the two bars are welded together adjacent a downward bend in the tree holder bar, the lower extremity of which has an upturned point to be driven into the trunk of the tree. A V-shaped bracket adjacent the bend in the tree holder bar receives a pair of nails to be driven into the sides of the tree trunk. The tree holder bar is bendable to make the tree stand straight.

2 Claims, 3 Drawing Figures

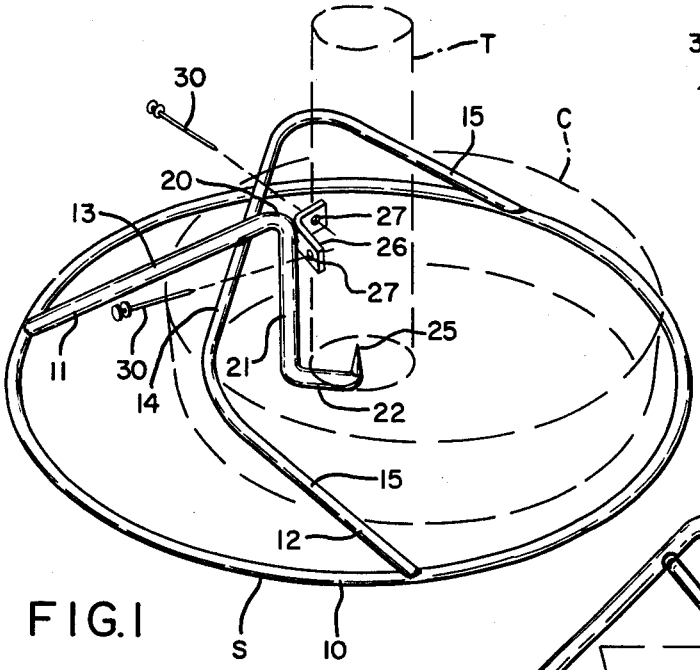
FIG.1
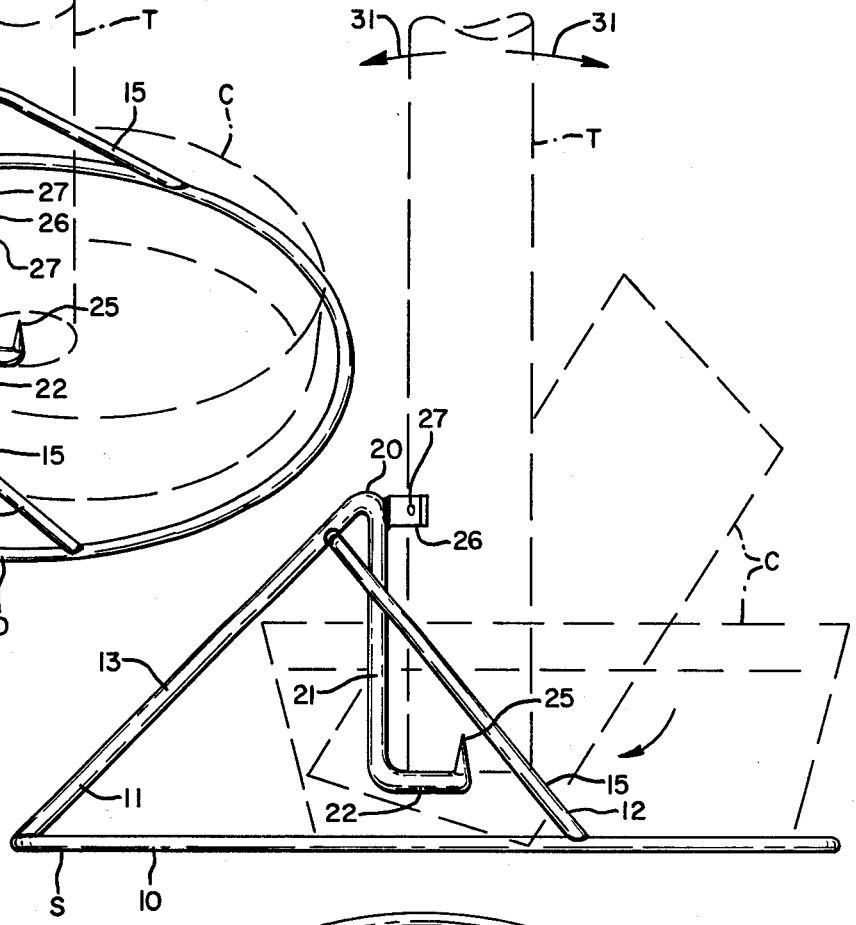
FIG.2
FIG.3
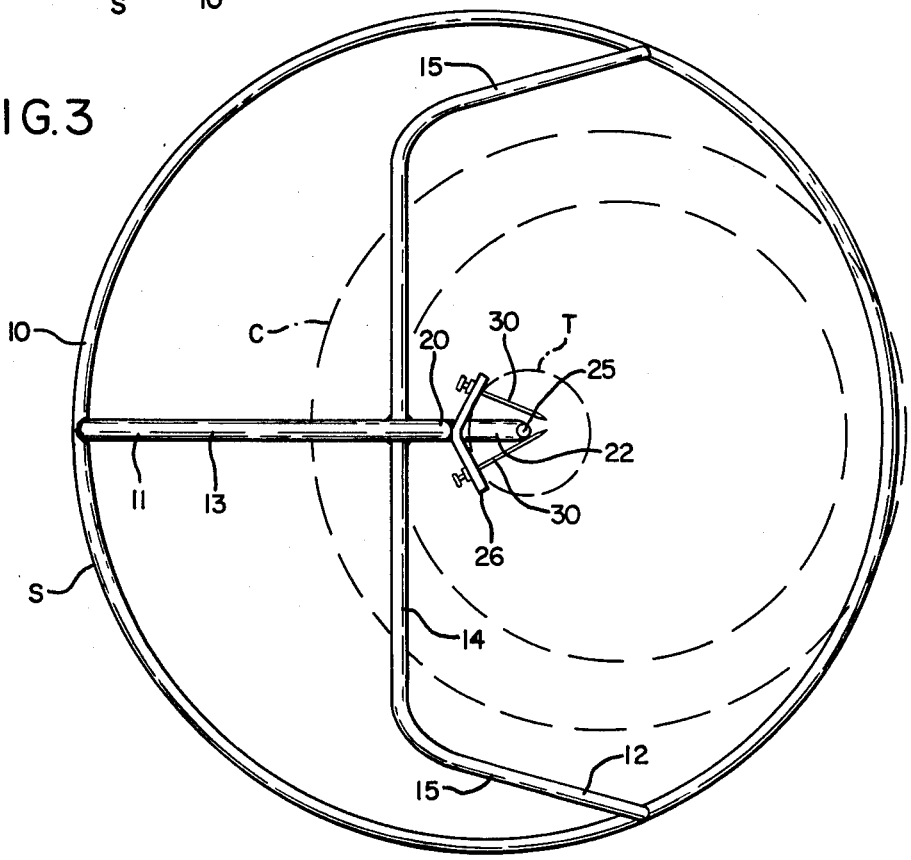

CHRISTMAS TREE STAND

BACKGROUND OF THE INVENTION

This invention relates to a Christmas tree stand.

There is room for considerable improvement in the various types of Christmas tree stands heretofore proposed. Most such stands do not have convenient means for attachment to the tree. Some require the trimming of limbs in order to fit the tree to the stand. Most do not have any means of adjustment to compensate for a bend in the trunk of the tree.

In an attempt to overcome these problems, most prior stands have become too complicated to be practical. The use of numerous parts increases the cost of manufacture and often causes annoyance to the user in assembling and adjusting the various parts. Also, such stands are usually not attractive in appearance.

SUMMARY OF THE INVENTION

The present stand is of extremely simple construction which is durable and easy to use. There are no parts to be assembled by the user and no adjustable parts to be manipulated to compensate for a bend in the trunk of the tree. The simple and sturdy construction makes the stand inexpensive to manufacture, attractive in appearance, and easy to use in the home or elsewhere.

The stand is made from three round metal bars welded together. One bar provides a circular base support to rest on the floor. An inclined tree holder bar has an upper end supported by an inclined U-shaped bar, the lower ends of both of these bars being welded to the base ring. The upper end of the tree holder bar is bent downward in a vertical direction for attachment to the tree. The lower end of this vertical portion is provided with an upturned point or spike to penetrate and support the lower end of the trunk and the upper end of the said vertical portion is equipped with a V-shaped bracket having nail holes for nails to be driven into the trunk. The tree holder bar is bendable at said bend to compensate for possible curvature in the trunk of the tree without making any adjustments in the stand.

The invention will be better understood and additional objects and advantages will become apparent from the following detailed description of the preferred embodiment illustrated in the accompanying drawings. Various changes may be made in the details of construction, and all such modifications within the scope of the appended claims are included in the invention.

BRIEF DESCRIPION OF THE DRAWINGS

FIG. 1 is a perspective view of the tree stand with the trunk of a tree and a water container shown in broken lines.

FIG. 2 is a side-elevation view.

FIG. 3 is a top-plan view.

DETAILED DESCRIPTION OF THE PREFERRED EMBODIMENT

The truck T of the tree is supported by the stand S with the lower end of the trunk projecting into a removable water container C.

The stand S comprises essentially three parts. These are a circular metal base ring 10, a tree holder bar 11 and a brace or support bar 12. Tree holder bar 11 has an inclined portion 13 welded at its lower end to base ring 10. Adjacent its upper end the inclined portion 13 is welded to a horizontal top portion 14 of support bar 12.

Support bar 12 is of inverted U-shape having two inclined legs 15 welded at their lower ends to base ring 10.

A short distance above the horizontal top portion 14 of support bar 12, the tree-holder bar 11 has a down-turned bend 20 forming the upper end of a vertical portion 21 of the tree holder bar. On the lower end of vertical portion 21 a short horizontal portion 22 has an up-turned spike or point 25. This point supports the lower end of the trunk T of the tree a short distance above the level of base ring 10.

The upper end of vertical portion 21 of tree holder bar 11 just below the bend 20, is welded to a V-shaped bracket 26 having a pair of nail holes 27 to receive the double-headed nails 30.

To mount the stand, the tree is laid in horizontal position on the floor and the point 25 is placed against the end of the tree trunk and tapped in firmly. Then the nails 30 are inserted into holes 27 in the V-bracket 26 and driven into the side of trunk T. The use of double-headed nails makes them easy to remove.

If the tree does not stand straight when the stand is turned upright, the operator places a foot on base ring 10 and pushes the tree to the desired position as indicated by arrows 31. The tree holder bar 11 will bend in its portion 20 to make adjusting the tree upright simple and easy. Usually, any bend in the trunk of a tree is in its lower portion and may be compensated by adjusting the bend 20, causing the usually straight upper portion of the trunk to assume a vertical position.

The water container C may be any receptacle available of suitable size, the bars 11 and 12 being arranged to provide an open space in the stand to receive the container. The stand may be set down over the container or if the container is of suitable shape, it may be inserted in the stand as shown in FIG. 2.

The arrangement of the trunk fastening connections at 25 and 26 makes it unnecessary to trim any low branches from the tree. These connections are adaptable to large and small tree trunks without making any adjustments in the stand. There are no movable parts.

What is claimed is:

1. A Christmas tree stand comprising a base ring, a tree holder bar having one end connected to said base ring and an upwardly inclined portion terminating in a downward bend above the center of said base ring, the opposite end of said bar having a free portion extending vertically downwardly from said bend and having a free lower end with an upturned point to secure the end of the tree trunk, a V-shaped bracket mounted at the apex of the V on the upper end of said vertical portion to receive the tree trunk between the arms of the V and having nail holes in said arms to receive nails to be driven into the tree trunk in angular relation, said bar being bendable at said bend by forcefully moving the tree trunk after the trunk has been secured by said upturned point and said nails to compensate for a bend in the tree trunk, an inverted U-shaped support bar having its lower ends connected to said base ring and having an upper portion connected to said inclined portion of said tree holder bar adjacent said bend, said upturned point holding the lower end of said tree trunk above the level of said base ring and said bars providing an open space therebetween to receive a water container for the tree within said base ring.

2. A Christmas tree stand comprising a base ring, a tree holder bar having one end connected to said base ring and an upwardly inclined portion terminating in a downward bend above the center of said base ring, an inverted U-shaped support bar having its lower ends connected to said base ring and having an upper portion connected to said inclined portion of said tree holder bar adjacent said bend, said bars providing an open space therebetween to receive a water container for the tree within said base ring, the opposite end of said tree holder bar having a free portion extending vertically downwardly downward from said bend and having a free lower end with an upturned point to secure the lower end of the tree trunk above the level of said base ring, a bracket mounted on the upper end of said vertical portion to receive a nail to be driven into the tree trunk, said tree holder bar being bendable at said bend by forcefully moving the tree trunk after the trunk has been secured by said upturned point and said nail to compensate for a bend in the tree trunk without any other adjustment mechanism on the tree stand.

* * * * *